United States Patent [19]

Yorita

[11] Patent Number: 4,740,662

[45] Date of Patent: Apr. 26, 1988

[54] VACUUM CIRCUIT INTERRUPTER

[75] Inventor: Mitsumasa Yorita, Amagasaki, Japan

[73] Assignee: Mitsubishi Denki Kabushiki Kaisha, Japan

[21] Appl. No.: 80,425

[22] Filed: Jul. 31, 1987

[30] Foreign Application Priority Data

Aug. 7, 1986 [JP] Japan ..... 61-187262

[51] Int. Cl.[4] ..... H01H 33/66

[52] U.S. Cl. ..... 200/144 B

[58] Field of Search ..... 200/144 B

[56] References Cited

U.S. PATENT DOCUMENTS 4,231,814 11/1980 Watanabe ..... 200/144 B 4,440,995 4/1984 Lange et al. ..... 200/144 B

FOREIGN PATENT DOCUMENTS 53-43491 10/1978 Japan .

*Primary Examiner*—Robert S. Macon

*Attorney, Agent, or Firm*—Leydig, Voit & Mayer

[57] ABSTRACT

A vacuum circuit interrupter comprising in a vacuum vessel at least a pair of separable stationary electrode and a movable electrode, and a main shield surrounding the electrodes. The axial length L of the main shield is greater than $T_1$ and smaller than $(T_1+T_2 \tan 45°)$, where $T_1$ is the distance which is the sum of the gap length between the electrodes when the electrodes are separated and the thicknesses of the electrodes, and $T_2$ is the shortest distance between the main shield and the electrodes.

4 Claims, 3 Drawing Sheets

$\ell_1 = (\phi_2 - \phi_1)/2 \cdot \tan\theta$ $$\ell_1 = (\phi_2 - \phi_1)/2 \cdot \tan\theta$$

VACUUM CIRCUIT INTERRUPTER

BACKGROUND OF THE INVENTION

This invention relates to a vacuum circuit interrupter and more particularly to the shield structure of a vacuum circuit interrupter.

FIG. 1 is a sectional view showing the structure of a conventional vacuum circuit interrupter disclosed in Japanese Utility Model Publication No. 53-43491, for example. In FIG. 1, the vacuum circuit interrupter comprises an electrically insulating tube 1 made of a glass or a ceramic material. A first flange 4 is attached to the upper end of the insulating tube 1 through a cylindrical sealing member 3, and a second flange 6 is attached to the lower end of the insulating tube 1 through a cylindrical sealing member 5. The first flange 4 has secured at its center a stationary electrode rod 8 having a stationary electrode 7 at its lower end, and the second flange 6 has secured at its center an axially expandable bellow 9, and the other end of the bellows 9 has mounted thereon a movable electrode rod 11 having at its tip a movable electrode 10 opposing the stationary electrode 7. The electrode rods 8 and 11 are axially aligned, and the insulating tube 1, the sealing members 3 and 5, the flanges 4 and 6, and the bellows 9 together constitute a vacuum vessel 12. A cylindrical main shield 13 of a circular cross-section is mounted at its central portion to the central portion of the insulating cylinder 1. Also, the upper and lower edges of the main shield 13 are inwardly rolled over. On the inner surface of the first flange 4 an outer shield 14 is provided, and on the upper surface of the second flange 6 an outer shield 15 is provided. Further, the outer shields 14 and 15 are of a cylindrical shape having an axial length slightly longer than that of the sealing members 3 and 5, and their end portions are bent inwardly to form concave surfaces at the portions facing the main shield 13. Also, between the end portions of the outer shields 14 and 15 and the opposite end portions of the main shield 13, a gap which is necessary for a withstand voltage and a gap which completely prevents the pollution of the insulating cylinder 1 resulting from the diffusion of the metallic vapor generated by the arc discharge are provided. Further, a bellows shield 16 surrounding the bellows 9 is mounted to the movable electrode rod 11.

With the conventional vacuum interrupter of the above-described structure, when the electrodes 7 and 10 are opened while an electric current flows through the electrode rods 8 and 11, an electric arc is generated across the electrodes 7 and 10. This arc melts the electrodes 7 and 10 and generates metal vapor to allow the vapor to diffuse into the vacuum sapce. In order to prevent pollution of the insulating vessel 1 by the metal vapor, the main shield 13 is provided thereby to trap most of the metal vapor. Further, the metal vapor which escapes from the upper and the lower ends of the main shield 13 is repelled back by the outer shields 14 and 15 and the flanges 4 and 6 to the inside of the main shield 13. This phenomenon occurs when the space between the electrodes 7 and 10 and the main shield 13 is large, and when the vacuum interrupter is very compact the arc generated across the electrodes 7 and 10 is driven to the outer periphery of the electrodes 7 and 10 by a magnetic field generated by the arc, often causing the main shield 13 to melt.

Since the conventional vacuum interrupter is constructed as described above, particles of the melted main shield 13 scatter in the axial direction of the main shield 13 and condense on the upper and the lower end portions of the main shield 13 and on the electrodes 7 and 10 when they reach the rounded portions. Therefore, the distances between the electrode 7 and the shield 13 as well as the electrode 10 and the shield 13 are shortened, decreasing the dielectric recovery characteristics during current interruption and the withstand voltage characteristics after currenet interruption.

SUMMARY OF THE INVENTION

Accordingly, an object of the present invention is to provide a vacuum circuit interrupter in which the dielectric recovery characteristics during current interruption and the withstand voltage characteristics after current interruption are not degraded.

With the above object in view, the vacuum circuit interrupter of the present invention is characterized in that the axial length L of said main shield is greater than $T_1$ and smaller than $(T_1+T_2 \tan 45°)$, where $T_1$ is the distance which is the sum of the gap length between said electrodes when said electrodes are separated and the thicknesses of said electrodes, and $T_2$ is the shortest distance between said main shield and said electrodes. The axial length of the main shield of the vacuum circuit interrupter of the present invention is properly determined so that the adverse effects of the scattering of the particles from the melted main shield is reduced.

BRIEF DESCRIPTION OF THE DRAWINGS

The present invention will become more readily apparent from the following detailed description of the preferred embodiments of the present invention taken in conjunction with the accompanying drawings, in which.

DETAILED DESCRIPTION OF THE PREFERRED EMBODIMENTS

Figure 1:
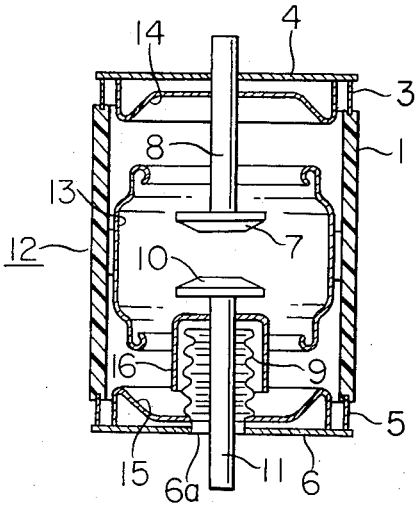
FIG. 1 PRIOR ART
FIG. 1 is a cross sectional view showing the conventional vacuum circuit interrupter.
Figure 2:
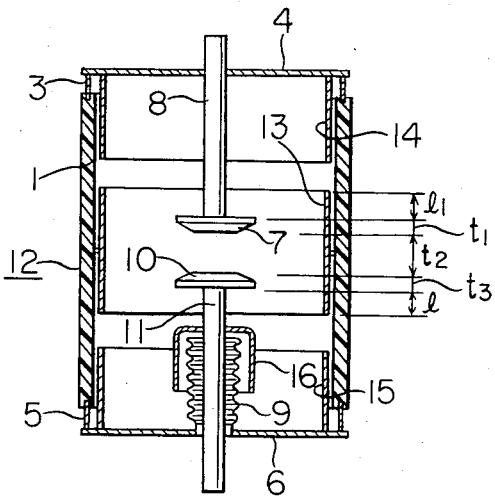
FIG. 2 is a cross sectional view showing a vacuum interrupter of one embodiment of the present invention.

One embodiment of the present invention will now be described. In FIG. 2, the vacuum circuit interrupter of the present invention comprises an electrically insulating cylinder 1 made of glass or ceramics, and a first flange 4 is attached to the upper end of the insulating cylinder 1 through a cylindrical sealing member 3, and a second flange 6 is attached to the lower end of the insulating cylinder 1 through a cylindrical sealing member 5. At the central portion of the first flange 4, a stationary electrode rod 8 having a stationary electrode 7 at its lower end portion is secured, and at the central portion of the second flange 6, an axially extending bellow 9 is secured, and at the other end of the bellow 9, a movable electrode rod 11 having at its tip a movable electrode 10 facing the stationary electrode 7 is attached. The electrode rods 8 and 11 are axially aligned, and the insulating cylinder 1, the sealing members 3 and 5, the flanges 4 and 6 and the bellow 9 together constitute a vacuum vessel 12. Within the insulating cylinder 1, a main shield 13 having a proper length with respect to the electrodes 7 and 10 is positioned. On the first flange 4 and the second flange 6, outer shields 14 and 15 are concentrically formed relative to the main shield 13 with a proper gap therebetween. Also, a bellows shield 16 covering around the bellows 9 is attached to the movable electrode rod 11.

Figure 7:
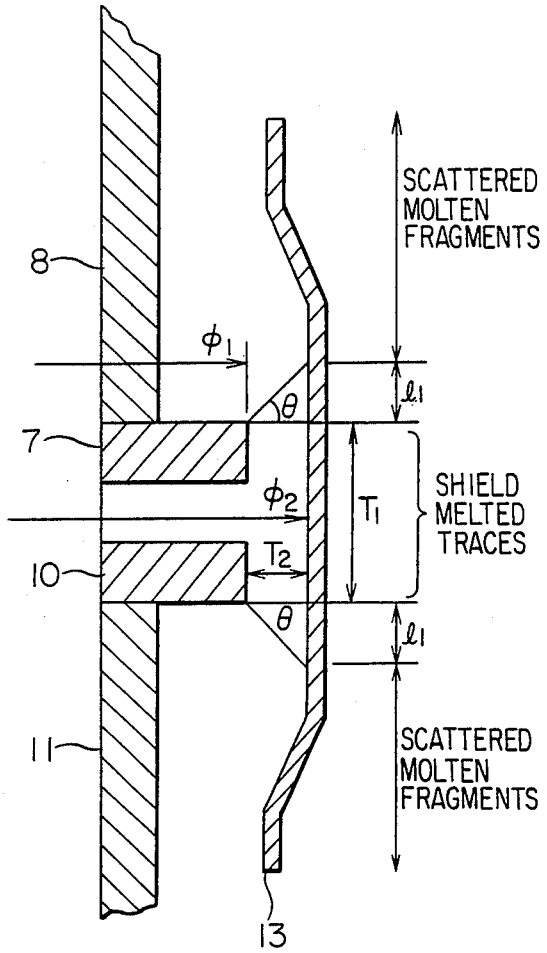
FIG. 7 is a distribution diagram showing the manner in which the melted shield fragments scatter in the vacuum interrupter.

Next, the explanation will be made as to the axial length of the main shield 13. FIG. 7 is a graph showing the distribution of the scattered molten fragments of the shield with respect to the vacuum interrupter. As seen from this graph, only shield molten traces are found in the vicinity of the electrodes 7 and 10, and scattered fragments of the molten shield can be found in the region starting from the position beyond distance $1_1$ from the back side of the electrodes 7 and 10. It has been experimentally found that this distance $1_1$ can be determined by a space defined by an outer diameter $\phi_1$ of the electrodes 7 and 10 and by an inner diameter $\phi_2$ of the main shield 13 and also by an angle $\theta$ as measured from the back side of the electrodes 7 and 10. That is, it has been experimentally determined that the distance $1_1$ can be expressed as $1_1=[(\phi_2-\phi_1)/2]\cdot \tan\theta$, and $\theta=45°$.

The value thus obtained was confirmed by experiments to the distance between the electrodes 7 and 10 and the shield 13.

Therefore, the length L of the main shield 13 in the axial direction is determined to be equal to or less than the value obtained by the following equation (1), wherein the thickness of the stationary electrode 7 is $t_1$, the separation distance between the stationary electrode 7 and the movable electrode 10 upon current interruption is $t_2$, and the thickness of the movable electrode 10 is $t_3$.

$$\{t_1+t_2+t_3+(\phi_2-\phi_1)\cdot\tan 45°\} \quad (1)$$

However, while the molten shield fragments which are attached to the main shield 13 as well as the metal vapor generated from the electrodes 7 and 10 in the conventional device is expected to stick to the portion except for the main shield 13, i.e. to the insulating cylinder 1, it has been confirmed that even when the scattered matters generated by the current interruption are attached to a portion of the insulating cylinder 1, the dielectric strength characteristics and the withstand voltage characteristics are not affected. Further, it has been experimentally confirmed that if the axial length L of the main shield 13 is not equal to or more than the value obtained by the following equation (2), then the insulating characteristics and the withstand voltage characteristics are adversely affected:

$$t_1+t_2+t_3 \quad (2)$$

Figure 3:
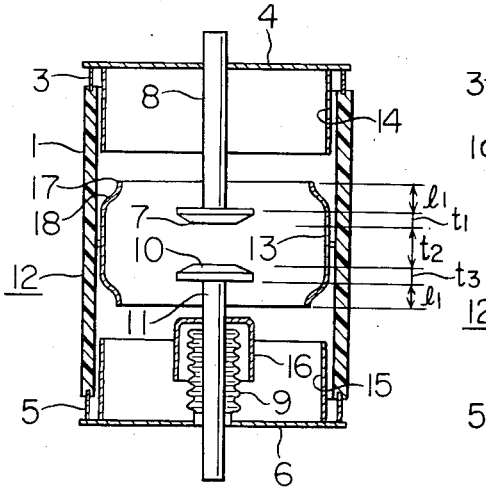
FIGS. 3 to 6 are cross sectional views showing vacuum interrupters of other embodiments of the present invention.
Figure 4:
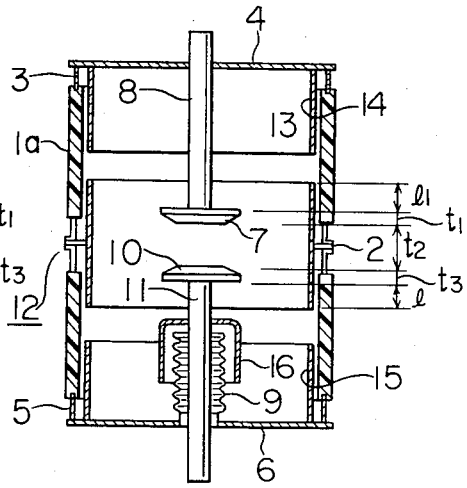
Figure 5:
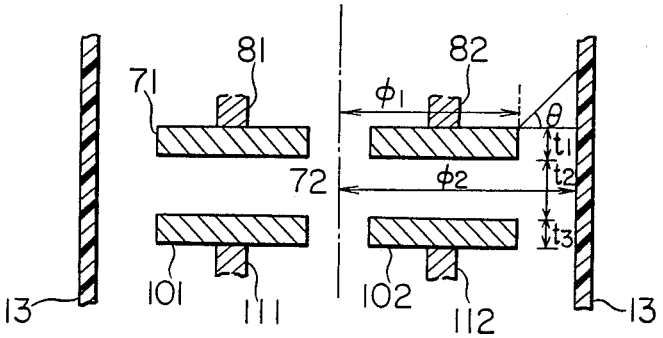

While the main shield 13 is a simple cylindrical shape member in the above embodiment, a similar advantageous effect can be obtained with the main shield 13 shown in FIG. 3 in which bent portions 18 and the small-diameter opening portions 17 are provided. Further, a similar advantageous effect can be obtained by the arrangement shown in FIG. 4 in which two insulating vessels 1a and 1b are connected by th connecting member 2 and in which the main shield 13 is disposed at the central portion.

Figure 6:
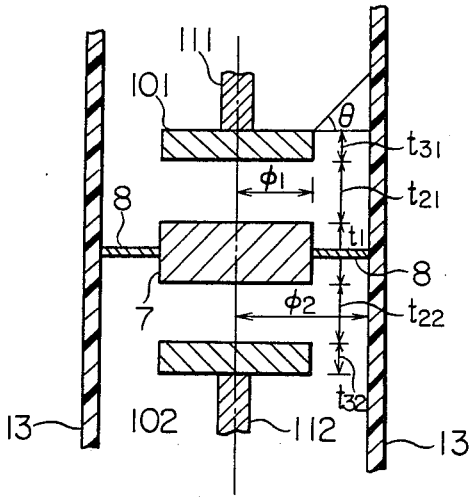

Further, while the above-described embodiments have a pair of stationary electrode 7 and the movable electrode 10 disposed within the vacuum vessel 12, the upper limit and the lower limit of the length L of the main shield 13 in the axial direction may be determined by applying the distance between the center line of the vacuum vessel 12 and the outer edge of the electrode to $\phi_1$ in the equations (1) and (2) even when two pairs of stationary electrodes 71 and 72 and movable electrodes 101 and 102 are disposed in parallel within the vacuum vessel 12. Further, when the movable electrode 101 is disposed above the stationary electrode 7 and the movable electrode 102 is disposed below the stationary electrode 7 in an axially aligned relationship as shown in FIG. 6, $t_2=t_{21}+t_{22}$ and $t_3=t_{3\ 1}+t_{32}$ can be applied to the equaltions (1) and (2) to determine the upper and the lower limits of the axial length L of the main shield 13, where $t_{31}$ is the thickness of the first movable electrode 101, $t_{31}$ is the thickness of the second movable electrode 102, $t_{21}$ is the length between the first movable electrode 101 and the stationary electrode 7 upon the current interruption, and $t_{22}$ is the gap length between the second movable electrode and the stationary electrode 7 upon the current interruption.

It is to be noted that the number of the electrode is not limited to those described above. Also, the present invention is not limited to vacuum switch tubes but also applicable to vacuum discharge apparatus such as a vacuum fuse.

As has been described, according to the present invention, the adverse effects of the shield molten fragments to the dielectric recovery characteristics and the withstand voltage characteristics can be reduced by selecting a proper axial length for the main shield.

What is claimed is:

1. A vacuum circuit interrupter comprising a vacuum vessel, at least a pair of a separable stationary electrode and a movable electrode, and a main shield surrounding the electrodes, the axial length L of said main shield being greater than $T_1$ and smaller than $(T_1+T_2 \tan 45°)$, where $T_1$ is the distance which is the sum of the gap length between said electrodes when said electrodes are separated and the thicknesses of said electrodes, and $T_2$ is the shortest distance between said main shield and said electrodes.

2. A vacuum circuit interrupter as claimed in claim 1 wherein the length L of said main shield is greater than $(t_1+t_2+t_3)$ and smaller than $\{t_1+t_2+t_3+(\phi_2-\phi_1) \tan 45°\}$, where $\phi_1$ is the diameter of a pair of stationary electrode and movable electrode, $\phi_2$ is the inner diameter of the main shield, $t_1$ is the thickness of said stationary electrode, $t_3$ is the thickness of said movable electrode, and $t_2$ is the gap length between said electrodes when said electrodes are separated.

3. A vacuum circuit interrupter as claimed in claim 1 wherein said main shield is of a simple cylinder.

4. A vacuum circuit interrupter as claimed in claim 1 wherein said main shield has an inner diameter of $\phi_2$ at the middle portion thereof and a rounded portion and a small-diameter portion at the opposite ends thereof.

* * * * *